US005195845A

United States Patent [19]

Parks

[11] Patent Number: 5,195,845

[45] Date of Patent: Mar. 23, 1993

[54] MONITORING FLOW IN SUBSOIL FLUIDIZATION

[76] Inventor: James M. Parks, 3509 Merrick Ct., #210, Lexington, Ky. 40502

[21] Appl. No.: 848,482

[22] Filed: Mar. 9, 1992

Related U.S. Application Data

[63] Continuation-in-part of Ser. No. 565,283, Aug. 1, 1990, Pat. No. 5,094,566.

[51] Int. Cl.[5] ..... E02B 3/02

[52] U.S. Cl. ..... 405/74; 405/73; 405/21

[58] Field of Search ..... 405/73, 74, 52, 163; 73/652, 862, 861.74, 170 A, 189, 188

[56] References Cited

U.S. PATENT DOCUMENTS

| | | | |
|---|---|---|---|
| 4,280,289 | 7/1981 | Bassompierre-Sewrin | 37/63 |
| 4,391,136 | 7/1983 | Perkins et al. | 73/170 H X |
| 4,448,068 | 5/1984 | Sutherland et al. | 73/170 H |
| 4,593,561 | 6/1986 | Gavrilovic | 73/170 H |
| 4,717,286 | 1/1988 | Loer | 405/74 |
| 4,898,495 | 2/1990 | Lin | 405/73 |
| 5,085,085 | 2/1992 | Anderson | 73/863.02 |
| 5,094,566 | 3/1992 | Parks | 405/74 |

*Primary Examiner*—Dennis L. Taylor
*Attorney, Agent, or Firm*—Charles A. McClure

[57] ABSTRACT

Monitoring fluidized flow of underwater non-cohesive subsoil. Fluid is jetted, as from a horizontal array of foraminous piping, into subjacent subsoil to fluidize it and preferably to transport it in an overhead lateral direction. Sensors at sites throughout the array monitor flows intercepted by vanes on stems upstanding from the array and transmit resulting data to a control system adapted to render the jetting intermittent, sequential, and of given durations.

16 Claims, 3 Drawing Sheets

MONITORING FLOW IN SUBSOIL FLUIDIZATION

This is a continuation-in-part of my copending application, Ser. No. 565,283 filed Aug. 1, 1990, now U.S. Pat. No. 5,094,566, granted Mar. 10, 1992, whose entire specification text and drawings are incorporated herein by this reference.

TECHNICAL FIELD

This invention concerns monitoring underwater flow of fluidized non-cohesive subsoil, as in fluidization deshoaling of waterways.

BACKGROUND OF THE INVENTION

My above noted application summarizes disadvantages of dredging and advantages of fluidizing shoaled subsoil for removal, including sequential jetting into subsoil from foraminous piping in an array.

Jetting order, intermittency, and duration can be controlled to optimize flow of fluidized subsoil in a desired direction, such as laterally above a fluidization piping array to an eduction or other transport location. Monitoring of such flow is conducive to optimal control and is facilitated by real-time sensing of flow conditions overhead relative to the array, as by appropriately located sensors.

SUMMARY OF THE INVENTION

A primary object of the present invention is effective sensing of fluidized non-cohesive subsoil flow above fluidization piping.

Another object of this invention is monitoring of both vertical and horizontal flow of fluidized subsoil.

A further object of the invention is improved control of flow of fluidizing fluid into subjacent subsoil.

Still another object of this invention is mounting of sensing means relative to a fluidization piping array.

Yet another object of the invention is controlling of the flow of fluidized subsoil laterally overhead of such array.

In general, the objects of the present invention are attained, in monitoring flow of non-cohesive subsoil fluidized via a substantially horizontal two-dimensional array of foraminous piping on or in the subsoil under water, by establishing monitoring sites underwater above the array, and sensing fluid flow at respective monitoring sites over time, with the added object of determining fluidized flow thereof, especially substantially lateral flow overhead.

Suitable apparatus conveniently includes flexible stems rising from anchoring points in the array, each with a stem-mounted vane oriented to intercept a preselected flow direction, and sensor means responsive to flow-induced stressing of stem and/or vane. Ancillary apparatus conveniently includes a computer, adapted to store flow values over time, to derive flow patterns from sensed data, and to enable control of jetting to control flow rate and direction.

Other objects of the present invention, together with means and methods for attaining the various objects, will become apparent from the following description and the accompanying diagrams of preferred embodiments presented here by way of example rather than limitation.

DESCRIPTION OF THE INVENTION

Figure 1:
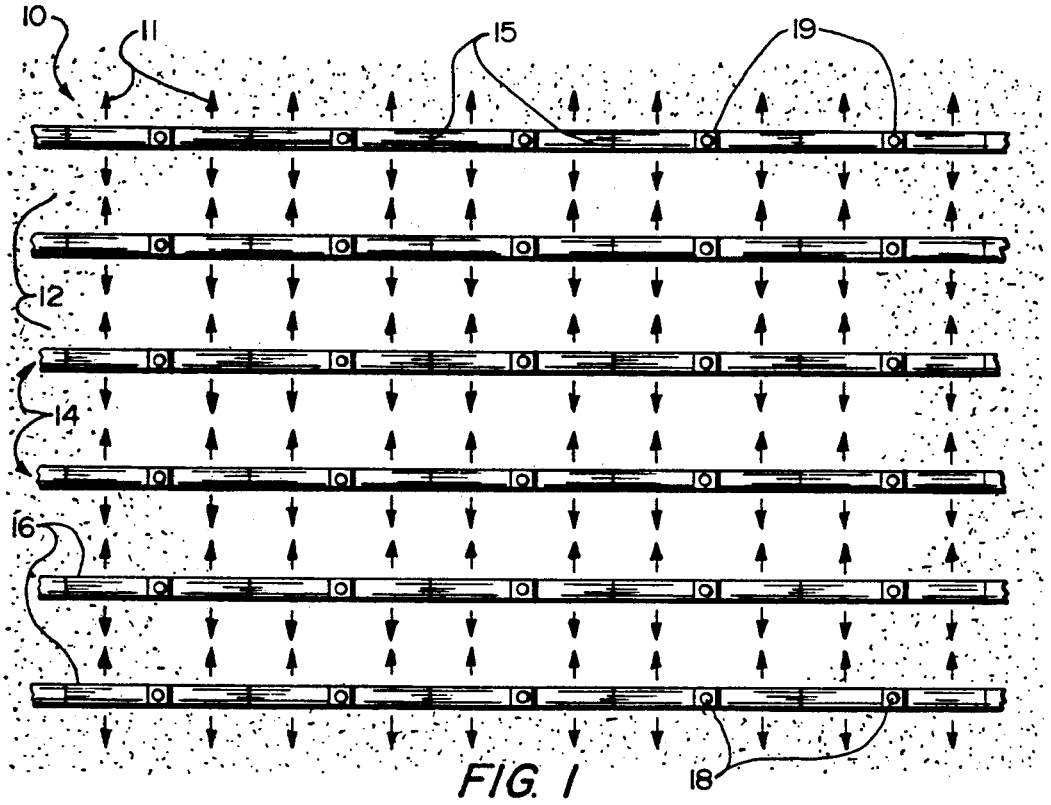
FIG. 1 is a fragmentary schematic plan of apparatus embodying the present invention presented as an underwater array of foraminous piping segments on or in non-cohesive subsoil.

FIG. 1 shows fragmentarily, in plan, a representative portion of foraminous fluidization piping array 10 sited on (or in) sandy or similarly non-coherent subsoil 12 (stippled). The array is made up of a half dozen parallel piping strings 14 spaced laterally from one another, each subdivided into a multiplicity of length segments 16 by periodically spaced internal barriers 15. Arrows 11 directed outward from both sides of each piping segment indicate fluid jetted into the subsoil through openings (unseen) in the foraminous piping. The openings are in the lower half of the piping and, therefore, not visible in this view because hidden by the upper half of the piping.

Power sources, pumps, valves, and piping or hoses for supplying fluid (water and/or air) to individual segments are omitted from the illustration for clarity but may be conventional and will be readily visualized by persons ordinarily skilled in the pertinent arts. The fluid supply is valved to supply each of the segments individually.

Each segment carries midway of its ends sensor housing 19 (square outline) supporting an upright stemlike rod or tube 18, (visible in FIG. 1 as a central dot). Retaining collars and flanges for the sensor housings appear in the next view.

Figure 2:
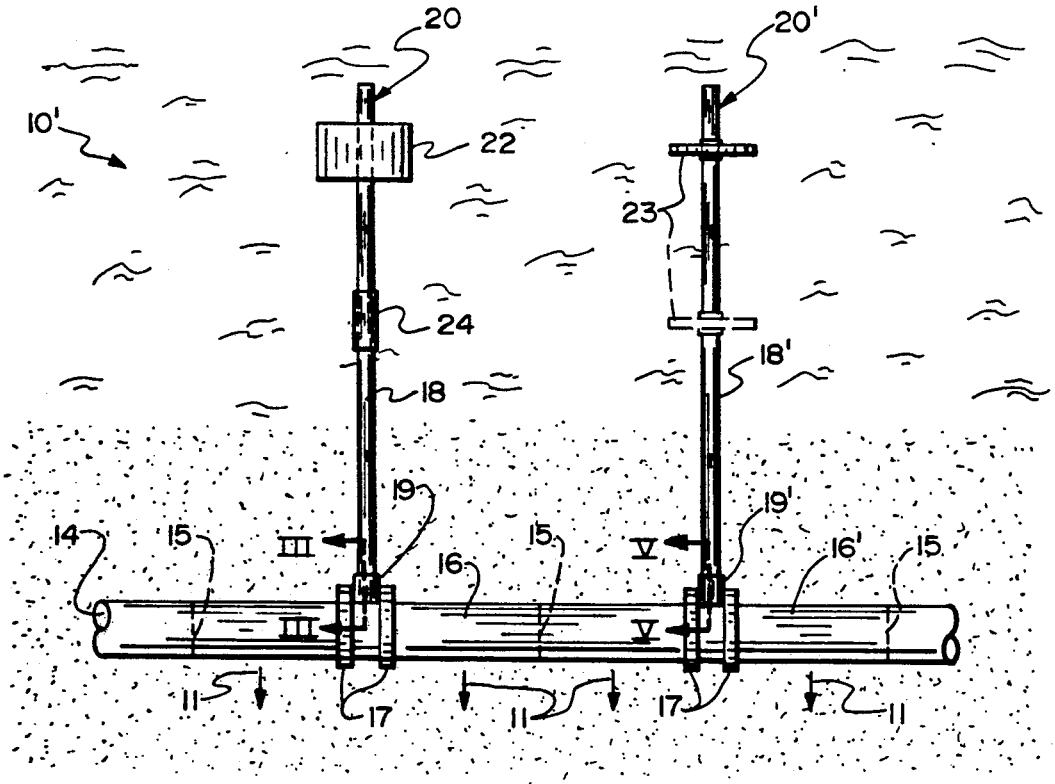
FIG. 2 is an enlarged fragmentary schematic elevation of the same apparatus, plus means for sensing horizontal and vertical flow.

FIG. 2 shows smaller array portion 10' in elevation. The lower half of this view is otherwise occupied by subsoil 12 (stippled), and the upper half is mainly by water 9 (dashes). Two entire (plus adjacent partial) end-to-end segments of single piping string 14 are visible, separated by internal barriers 15 (dashed). Upright stems 18, 18' rise from sensor housings 19, 19' midway of the respective piping segments, through the subsoil and into the overlying water.

Stem assembly 20 at the left in FIG. 2 has vertical vane 22 mounted face-on (to the near the top of stem 18 vane 24 mounted edge-on, about midway between the stem top and bottom, for sensing non-vertical flow(s) at the corresponding level(s) on the stem. Stem assembly 20' at the right has horizontal vane 23, shown near the top of its stem 18' and in an alternative position (dashed) about midway of the stem, for sensing non-horizontal flow. Vane mountings preferably adjust vertically, regardless of vane type, as by a sliding fit plus set-screw contact with the stem. Each vane is adapted to intercept a sample portion of the flow and to urge the stem similarly, especially at its base—where pressure sensors are present in the housing, as shown in subsequent views.

Figure 3:
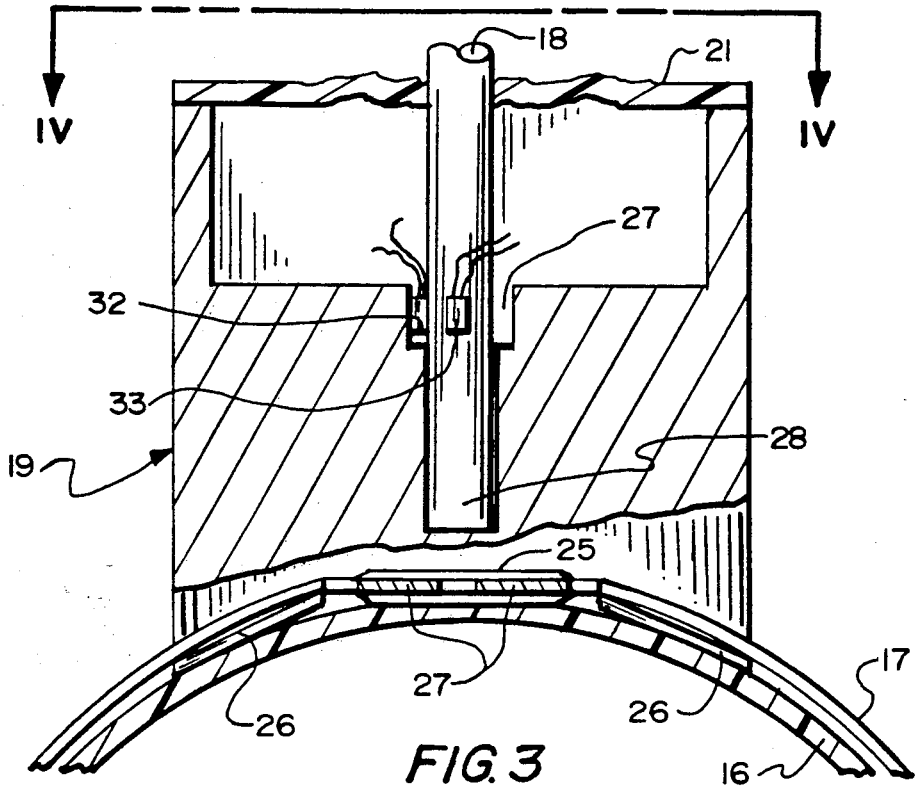
FIG. 3 is a further enlarged schematic sectional elevation, at III—III on FIG. 2, of means adapted to sense horizontal flow.

FIG. 3 shows sensor housing 19 of left stem 18 retained in place on top of piping segment 16 by collars 17 (one visible) over side flanges 26 (one pair visible) extending obliquely out and down from the base of the sensor housing. Each collar terminates in pair of end portions oppositely threaded into turnbuckle 25 located between the adjacent flanges. The turnbuckle is adapted (when turned in one direction) to tighten the collar, and to retain interposed housing flanges securely in place between collar and piping, and/or (when turned oppositely) to loosen both collar and housing. It will be understood that the customary polymeric foraminous piping flexes somewhat under the tension of the collars and the resulting pressure of the housing flanges against the piping.

Sensor housing 19 is sectioned to show the interior. Base 28 of stem 18 fits into a vertical blind bore having enlarged entry 27 in the base portion of the housing. Pressure transducers 32, 33 are interposed between the outside of the stem and the sidewall of the entry portion. The transducers are mounted in conformity with the orthogonal mounting of the vanes, as is useful in measuring (for example) respective North-South and East-West flow components with a single stem. Transducer 32, correlated with upper vane 22, appears edge-on, whereas transducer 33, for lower vane 24, appears face-on. Pairs of electrical leads from the respective illustrated pair of transducers appear fragmentarily, it being understood that they lead to remote processing apparatus (shown subsequently) or to a signal transmitter (not shown, in the sensor housing) to such apparatus. Flexible cover 21 closes the otherwise open top of the housing while permitting stem 18 to flex in accordance with flow sensed overhead.

Figure 4:
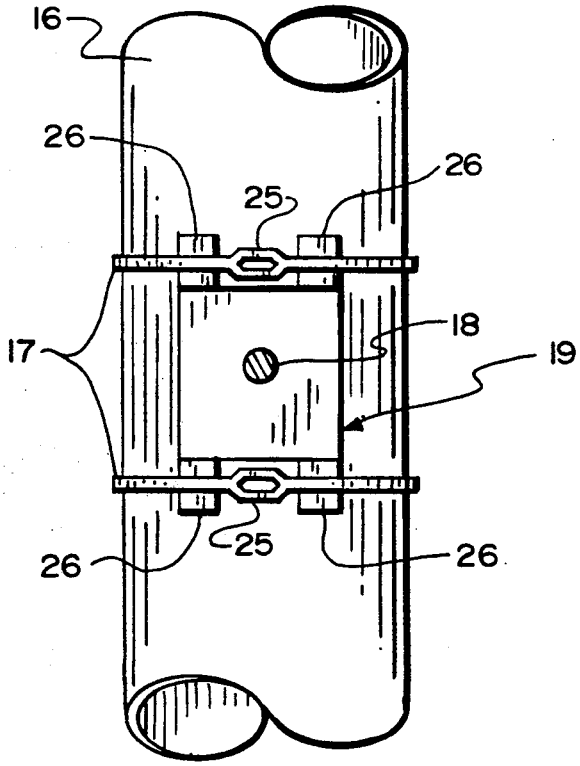
FIG. 4 is a reduced plan view of the same, at IV—IV in FIG. 3.

FIG. 4 shows (on a reduced scale) a corresponding plan view of the apparatus of FIG. 3, with the upper portion of stem 18 cut away. The center of the view is occupied by sensor housing 19, with pairs of flanges 26 extending in both directions along piping segment 16. Collars 17 flank the housing and encircle the segment and also overlap respective pairs of housing flanges 26. Turnbuckles 25 on the threaded ends of the collars are available to tighten them and so to hold the housing securely in place on top of the piping segment.

Figure 5:
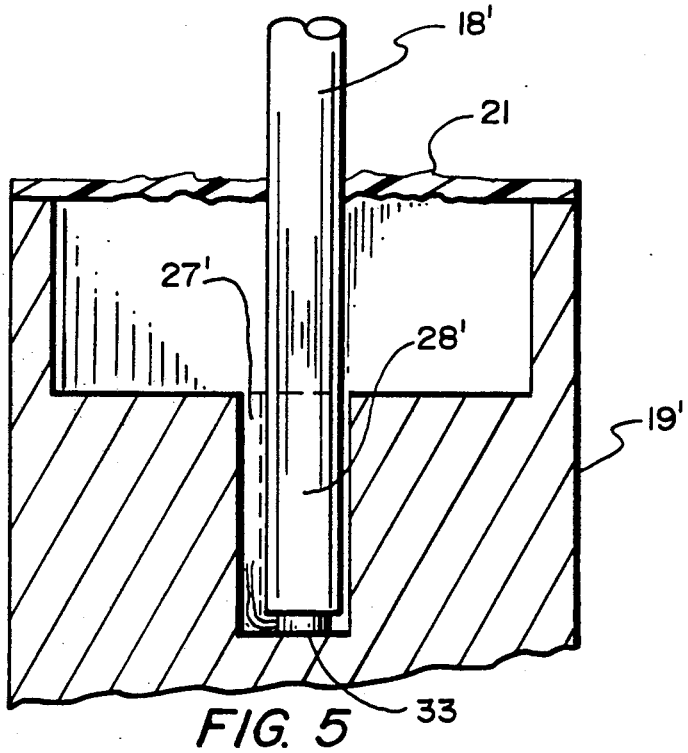
FIG. 5 is a fragmentary schematic sectional elevation, taken along V—V on FIG. 2, of means adapted to sense vertical flow.

FIG. 5 (scaled like FIG. 2) shows sensor housing 19' of right stem cut away to show single pressure transducer 33 mounted between (and affixed to) the bottom end of stem base 28' and the bottom of a similar vertical blind bore in the housing. Only part 27' of the entry to the bore is enlarged, all the way to the bottom, to enable electrical leads (unnumbered and shown only fragmentarily) to erupt from the transducer to the general interior of the housing. Such transducer is responsive to vertical stresses imposed upon the stem by previously illustrated horizontal vane 22.

Figure 6:
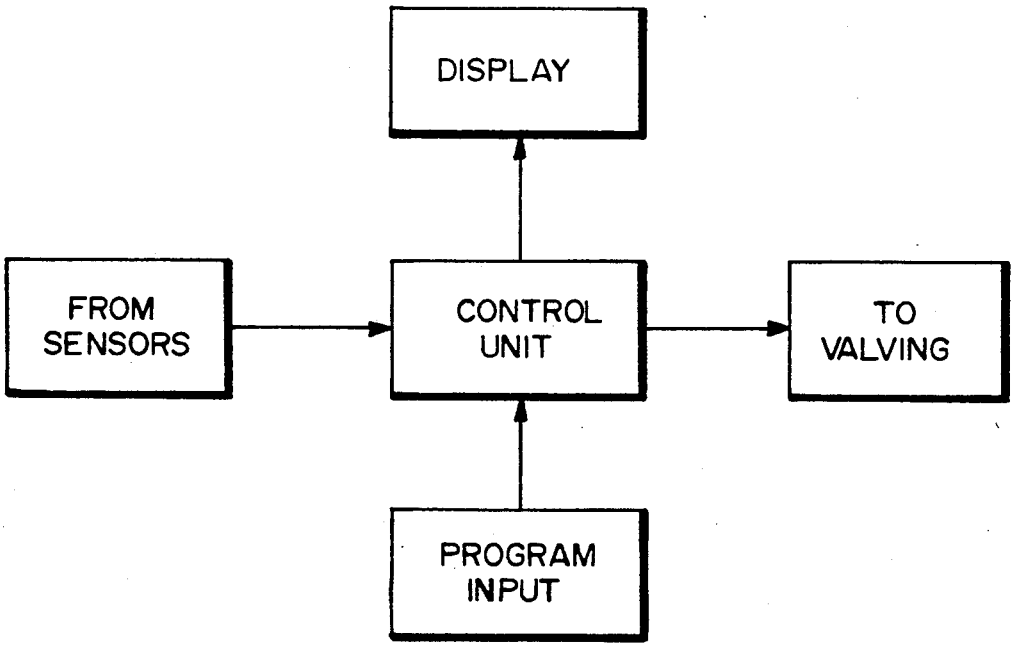
FIG. 6 is a schematic block diagram of apparatus for processing and storing sensed flow data, for deriving flow patterns from the data, and for controlling fluid jetting from the foraminous piping.

FIG. 6 shows in schematic block diagram form a CONTROL UNIT, conveniently in the form of a digital computer, including one or more central processing units (CPUs) and analog-to-digital modems to convert analog signals from the sensors to digital signals for processing. Valving control signals are conveniently of ON/OFF binary type, for intermittent timing, but analog signals can be output instead for graded control if desired. The PROGRAM INPUT component conveniently includes a keyboard and means for reading magnetic and/or optical program disks or the like. The DISPLAY means can show assumed or measured physical conditions, including not only real-time values of parameters being monitored by the underwater sensors but also the results of three-dimensional flow projections or simulations such as may be provided by CPU(s) in the CONTROL UNIT. Underwater contours can be measured by accessory means (not shown) and be utilized also.

Emplacement and operation of the apparatus already illustrated and described will be readily understood. Piping is provided with openings in part of its circumferential extent, subdivided lengthwise into segments of suitable length (e.g., ten to a dozen meters). The piping is lowered into the water along a desired route of fluidization until resting on the subsoil. The length segments are individually preconnected by hoses or pipes to an available source, whether before or after immersion. The collars may be secured to the piping at any time before securing the sensor housings in place. The collars conveniently have a conventional quick-disconnect joint.

The sensor housings, with the stems extending from them, are secured, as by tightening the collars over the housing flanges when most convenient, either before or after immersion but before burial of the piping, each stem with the vane(s) adjusted into desired position thereon. In the absence of some other means of transmission of sensed data from the sensor housing, the sensor leads are run conveniently along the top of the piping and are connected for input to the control system, such as through a multiplexer. Alternatively, low-frequency transmission from the sensor housings may be employed. Similarly, output leads are connected to valves (not shown) in respective fluid supply hoses or pipes (not shown) for individual piping segments.

The foraminous piping is supplied with fluid, as by pumping or gravity flow, either to all segments simultaneously or sequentially to successive segments along given length of piping. Resultant jetting of fluid downward (and outward) from the piping openings into subjacent non-cohesive subsoil fluidizes it and enables the piping to bury itself or be buried with aid of externally applied downward force. Emplacement of parallel strings of piping provides a three-dimensional array, preferably in a substantially horizontal plane.

A map of the array, with the locations (plan and elevation) of the horizontal vanes and of the respective vertical vanes is stored in the memory of the control system to enable sensed flow data to be allocated properly and to enable fluid for jetting to be supplied to respective segments of the array in sequences and for durations conducive to the results sought, including observation and control of overhead flow patterns. Skillful control may move fluidized subsoil into a natural current adapted to transport the subsoil to a desired location outside the array or to a location within the array from which it can be educted to a barge or other means of transport to a more remote discharge location.

A principal function of the program input is to time the opening and closing of the fluidization valves so as to produce the desired lateral transport of the non-cohesive subsoil. Such programming may be done in advance or may be done in real time by a human operator, as will be readily understood. Valve control is guided by a theoretical understanding of the physical conditions being dealt with and/or by monitoring of changes in physical conditions as they are being achieved, preferably by both such types of input. Sensed water flow and/or pressure can constitute suitable input signals.

Whether an overhead flow in substantially a horizontal plane proceeds parallel to the piping string direction or thereacross, it is considered lateral for present purposes insofar as it increases the distance (in plan) of the subsoil away from its point of origin. Such lateral transport of non-cohesive subsoil (such as sand) is achievable by sequential valving control along or across the array in an analog of "peristaltic" action according to this invention. As the pressure increases sequentially in any given sequential jetting direction, overhead lateral water flow occurs along the resulting horizontal pressure gradient, mainly in the opposite direction. For example, sequencing the jetting toward the shore can transport the subsoil to a location far enough offshore to intercept a longshore drift effective to convey it away. Contrariwise, sequencing the jetting from near to far from shore can enhance a beach, especially when assisted by beachface dewatering.

If a channel is to be cleared, the array should be emplaced to occupy a major part of the channel width and length, including any shoals therein. Sequencing of jetting from opposite sides inward to the channel centerline will produce net overhead flow outward from the centerline to the sides, thereby restoring desired navigability.

It is also possible to produce a double gradient from opposite sides of the array toward a centerline (or even to an array center) by fluidization valve sequencing outward from such centerline toward the sides (or out in all directions to the perimeter), so as to produce a net flow of fluidized subsoil from the outer reaches of the array to such centralized line (or point) as an eduction locus. Eduction there will accentuate the gradient in such direction(s).

An eduction pipe may be supported on a barge, from a crane, or by a platform rigged onshore or offshore. It may be movable, as along a centerline between flanking fluidization pipes. A pump may be provided at or near the intake end and may be supplemented by one or more additional pumps along its length.

Selection of appropriate pumps, piping, valving, and the like is well within the skill of persons familiar with hydraulic arts. A polymeric hydrocarbon, such as polyethylene or polypropylene, preferably high-density, of halogenated vinyl, such as polyvinyl chloride, is generally suitable. Fluidization piping should have its jetting openings oriented principally downward, only secondarily sideward, so as to fluidize mainly the subjacent subsoil. Normally fluidization piping can be left in place for years without necessity for unusual maintenance or repair but should be operated frequently if only for short times to keep the jet openings free of potentially clogging marine growth or other deposits.

Pressure transducers, such as piezoelectric devices, are readily available and are relatively easy to secure in place, as by cementing. One supplier with a broad transducer (or strain gauge) product line is Entran Devices, Inc. of Fairfield, N.J.

The sensor vanes may be replaced by a torsion cup anemometer if desired, as in conjunction with a base-mounted torsion-responsive transducer, for measuring flow rate. Then individual or multiple sensing vanes can be replaced by the usual weathervane type of vane for direction, and an omnidirectional transducer (or radial set of transducers) be substituted for one per vane (previously suggested).

Programming of sequential fluidization has been considered at some length herein, but as in most endeavors there is no substitute for experience. A skilled human operator may become able to "play" the keyboard of the control system to produce the most effective peristaltic action, with the benefit of a graphical read-out or pictorial representation of the sensed underwater flow of the fluidized subsoil. A skilled programmer may produce site-specific programs for deshoaling a channel, or—once cleared—for maintaining it clear by intermittent operation.

Specialized programs may include countering a periodic tendency to clog one side of a channel by evening out the tendency as a weekly, monthly, or seasonal add-on to a basic channel maintenance routine. Continual monitoring enables accumulation of contour and flow data—and correlation thereof to interpret the efficacy of many chosen patterns of jetting duration, intermittency, and sequencing.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

The claimed invention is:

1. Method of monitoring flow of non-cohesive subsoil fluidized via fluid jetting from a substantially horizontal two-dimensional underwater array of foraminous piping into the subjacent subsoil, comprising the steps of establishing monitoring sites underwater above the array, sensing fluid flow at respective monitoring sites over time, including sensing flow in orthogonal directions at various of the sites, and including sensing vertical flow as well as orthogonal horizontal flows.

2. Apparatus for monitoring flow of non-cohesive subsoil fluidized via a substantially horizontal two-dimensional array of underwater foraminous piping on or in the subsoil, comprising a flexible stem rising from an anchoring point in the array, vane means on the stem adapted to intercept fluidized flow, sensing means responsive to stressing of the flexible stem and adapted to generate data indicative of the degree of such stressing.

3. Flow-monitoring apparatus according to claim 2, wherein the sensing means is located alongside the base of the stem and is responsive to horizontal flow.

4. Flow-monitoring apparatus according to claim 2, wherein the sensing means is located at about the base of the stem and is responsive to vertical flow.

5. Flow-monitoring apparatus according to claim 2, including means housing the sensing means on top of the foraminous piping.

6. Flow-monitoring apparatus including a three-dimensional array of sensory sites with flexible stems according to claim 2, including computer means adapted to process successions of such data from sites in the array into flow patterns.

7. Apparatus for fluidizing underwater non-cohesive subsoil to flow in desired manner, comprising a substantially horizontal two-dimensional array of foraminous means having throughout the array separably controllable jetting sites adapted to jet fluid into subjacent subsoil to fluidize it, control means adapted to render such jetting intermittent and to sequence such intermittent jetting variously at separate sites.

8. Apparatus according to claim 7, including throughout the array means upstanding therefrom and adapted to intercept overhead fluidized flow of non-cohesive subsoil.

9. Apparatus according to claim 8, including flow-sensing means responsive to intercepted overhead flow and adapted to send sensed flow data to the control means.

10. Apparatus according to claim 7, wherein the foraminous means comprises a plurality of piping strings, each segmented into separably controllable jetting sites.

11. Method of controlling fluidization of non-cohesive underwater subsoil, comprising jetting fluid thereinto from individually controllable sites located in a substantially horizontal array on or in the subsoil, including rendering such jetting intermittent and sequencing such intermittent jetting variously at separate sites.

12. Method according to claim 11, including so jetting fluid from separate sites intermittently in sequences and for durations conducive to fluidized flow laterally overhead.

13. Method according to claim 12, including sensing flows of fluidized subsoil in vertical and orthogonal horizontal directions above the array.

14. Method according to claim 13, including deriving from the sensed flows a three-dimensional pattern of flow above of the array, including especially lateral overhead flow.

15. Controlling the overhead lateral flow of claim 14 to favor a direction outward relative to the plan periphery of the array.

16. Controlling the overhead lateral flow of claim 14 to favor a direction inward relative to the plan periphery of the array.

* * * * *